US007198493B2

(12) United States Patent
Chen et al.

(10) Patent No.: US 7,198,493 B2
(45) Date of Patent: Apr. 3, 2007

(54) ELECTRICAL CONNECTOR

(75) Inventors: Li-Bang Chen, Tu-Chen (TW); Yao-Chi Huang, Tu-Chen (TW); Alu Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/251,214

(22) Filed: Oct. 14, 2005

(65) Prior Publication Data

US 2006/0094263 A1 May 4, 2006

(30) Foreign Application Priority Data

Oct. 15, 2004 (TW) ..... 93216436 U

(51) Int. Cl.
*H01R 12/00* (2006.01)

(52) U.S. Cl. ..... 439/66

(58) Field of Classification Search ..... 439/66, 439/660, 342, 876
See application file for complete search history.

(56) References Cited

U.S. PATENT DOCUMENTS 5,692,920 A * 12/1997 Banakis et al. ..... 439/342
5,934,951 A * 8/1999 Lai et al. ..... 439/876
5,971,809 A * 10/1999 Ho ..... 439/660
6,164,978 A * 12/2000 McHugh et al. ..... 439/66
6,290,555 B1 * 9/2001 Nubuyuki et al. ..... 439/876
2004/0077190 A1 * 4/2004 Huang et al. ..... 439/66
2004/0102063 A1 * 5/2004 Yin et al. ..... 439/66
2004/0192081 A1 * 9/2004 Koopman et al. ..... 439/66
2004/0235316 A1 * 11/2004 Liao et al. ..... 439/66
2004/0253847 A1 * 12/2004 Ma ..... 439/66
2005/0054218 A1 * 3/2005 Liao et al. ..... 439/66
2005/0233606 A1 * 10/2005 Liao et al. ..... 439/66
2005/0245106 A1 * 11/2005 Ma ..... 439/66

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

Provided is an electrical connector (3) including an insulative housing (20) defining a number of passageways (202) and a number of contacts (1) received in the corresponding passageways, respectively. Each passageway defines a T-shaped cross-sectional configuration including a narrow fastening slot (2021) and a wide receiving slot (2022) communicated with each other. The contact forms a planar medial section (14) interferingly secured in the fastening slot and a dome-shaped bulge (142) projecting from the planar medial section. A lying wall (2024) adjacent the narrow fastening slot correspondingly defines a recess (2023) to receive the bulge. Therefore, the contact can be securely retained in the passageway and free from disengaging or deflecting from the passageway.

8 Claims, 5 Drawing Sheets

ELECTRICAL CONNECTOR

BACKGROUND OF THE INVENTION

1. Field of the Invention

The present invention generally relates to the art of electrical connectors and, more particularly, to an electrical connector for providing stable electrical connection between two separate electronic components.

2. Background of the Invention

Electrical connectors are widely used in personal computer systems to electrically connect a variety of electronic components, such as a printed circuit board (PCB) and an integrated circuit (IC) package. Basically, an electrical connector includes an insulative housing and a plurality of contacts embedded in the insulative housing. Each of the contacts electrically registers with a circuit pad on the PCB and a conductive pad on the IC package at two opposite ends thereof, and, therefore, establishes an electrical route between the conductive pad and the circuit pad.

Typically, an electrical connector includes an insulative housing defining a plurality of passageways therein and a plurality of contacts secured in the corresponding passageways, respectively. Each passageway includes a narrow fastening slot and a wide receiving slot in communication with each other. A pair of stepped sidewalls is provided at opposite lateral sides of the narrow fastening slot.

Each contact includes a planar medial section and a pair of spring arms extending from two opposite ends of the medial section. The medial section is formed with a pair of fastening block extending laterally in coplanar manner with the medial section. When the contact is in a wholly inserted position, the fastening blocks of the planar medial section interfere with the stepped sidewalls so as to retain the contact in the passageway.

However, the contact secured in the corresponding passageway via interferential engagement between the fastening blocks and the stepped lateral sidewalls is prone to disengage from the passageway, which may adversely affect electrical connection between the PCB and the IC package.

Therefore, there is a heretofore unaddressed need in the industry to address the aforementioned deficiencies or at least to provide the public with a useful choice.

SUMMARY OF THE INVENTION

A preferred embodiment of the present invention provides an electrical connector including an insulative housing defining a number of passageways therein and a number of contacts planted in the corresponding passageways, respectively. Each passageway defines a T-shaped horizontally cross-sectional configuration including a narrow fastening slot and a wide receiving slot in communication with each other. The contact includes a planar medial section interferingly secured in the fastening slot and a bulge integrally extending from the planar medial section. A lying wall adjacent the narrow fastening slot correspondingly defines a recess to receive the bulge.

The mate between the dome-shaped bulge and the recess not only reinforces the inferential engagement between the planar medial section and the insulative housing, but also prevents the contact from deflecting from the insulative housing. As a result, the contact can be stably and securely held in the passageway and, therefore, stable electrical connection between the PCB and the IC package is achieved.

Other features and advantages of the present invention will become more apparent to those skilled in the art upon examination of the following drawings and detailed description of preferred embodiment, in which:

DETAILED DESCRIPTION OF THE PREFERRED EMBODIMENT

Figure 1:
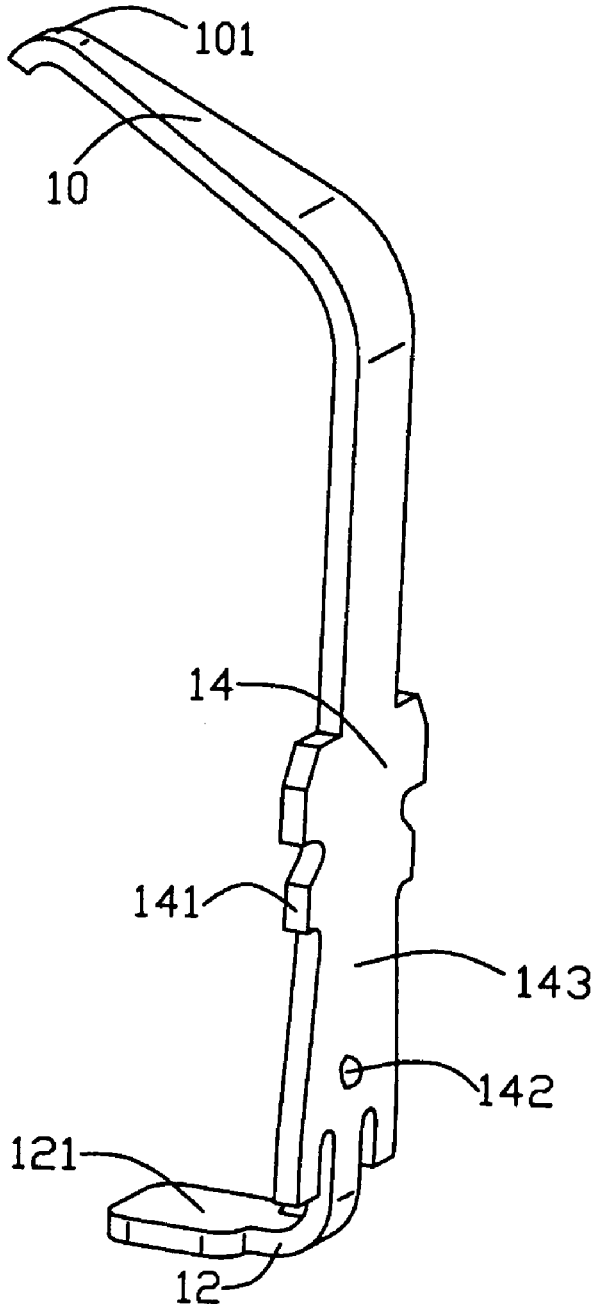
FIG. 1 depicts an isometric view of a contact for use in an electrical connector according to a preferred embodiment of the present invention.
Figure 2:
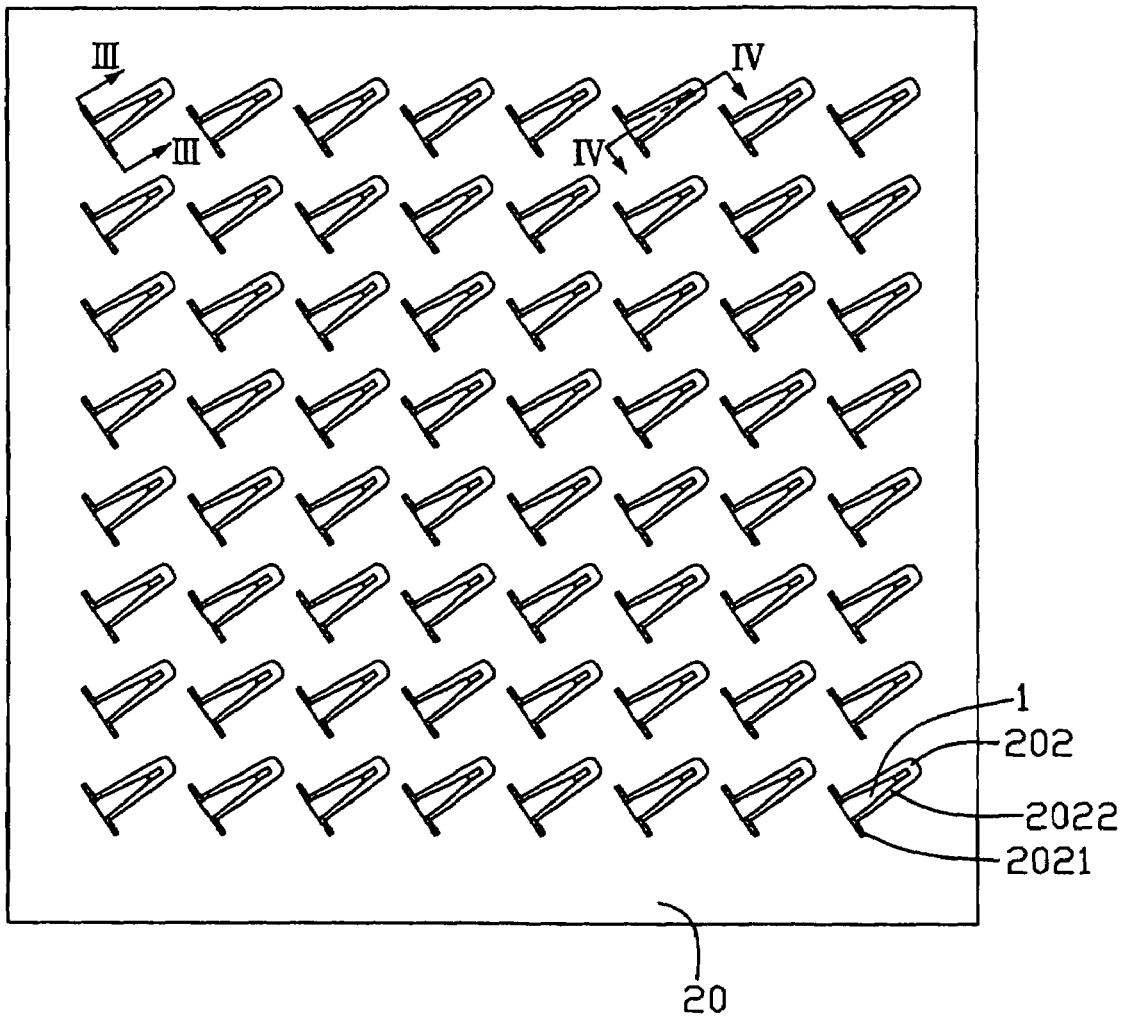
FIG. 2 depicts a top plan view of a plurality of contacts as per the contact of FIG. 1 held in corresponding passageways defined in an insulative housing of the electrical connector.

Reference will now be made to describe the preferred embodiment of the present invention in detail.

Referring to FIGS. 1 to 5, an electrical connector 3 in accord with a preferred embodiment of the present invention is used to electrically connect an IC package 4 and a PCB 5. The electrical connector 3 includes an insulative housing 20 defining a plurality of passageways 202 and a plurality of contacts 1 secured in the corresponding passageways 202, respectively.

Figure 3:
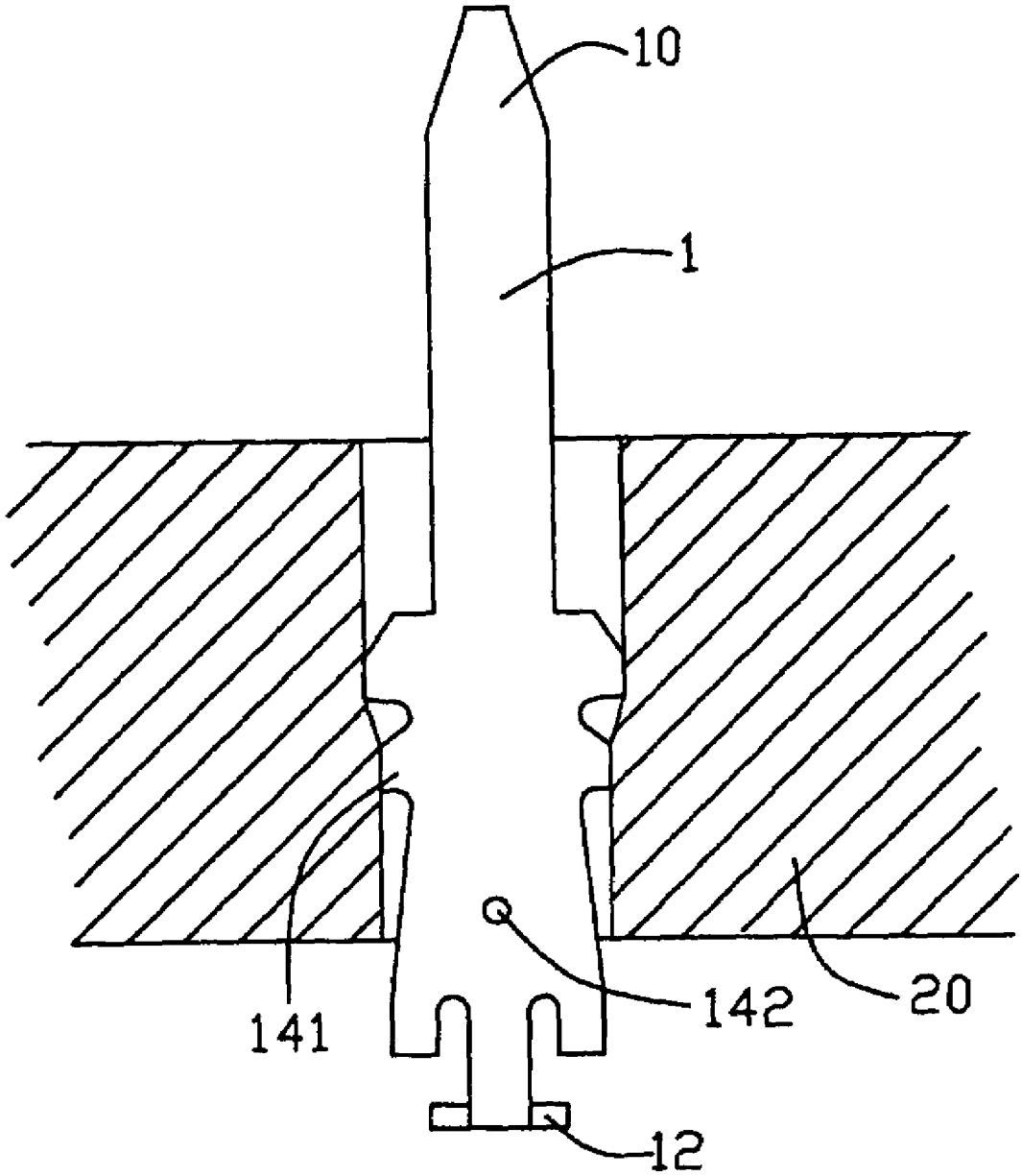
FIG. 3 depicts a partially cross-sectional view of the electrical connector taken in the direction of line III—III of FIG. 2.

Referring to FIG. 1 and FIG. 3, the contact 1, which is stamped and formed from a material strip, includes a planar medial section 14 to interfere with a narrow fastening slot 2021 of the passageway 202. An upper spring arm 10 and a lower soldering section 12 extend from opposite ends of the planar medial section 14 along a same direction, and, therefore, the contact 1 takes on a C-shaped configuration.

The planar medial section 14 defines a relying surface 143 extending vertically between the upper spring arm 10 and the lower soldering section 12. An upper and a lower fastening blocks 141 stretch out in a coplanar manner with the relying surface 143. The upper and the lower fastening blocks 141 are laterally dimensioned different from each other in accord with different lateral structure of the narrow fastening slot 2021. Dome-shaped bulge 142 adjacent the lower soldering section 12 projects from the planar medial section 14, to be received in a recess 2023 correspondingly defined in the insulative housing 20 encircling the narrow fastening slot 2021.

The upper spring arm 10 of the contact 1 includes an arched apex 101 at a free end thereof to elastically and electrically engage the conductive pad 41 of the IC package 4. The lower soldering section 12 of the contact 1 has a planar soldering pad 121 to be connected to a corresponding circuit pad 52 on the PCB 5 via a soldering ball 51.

Figure 5:
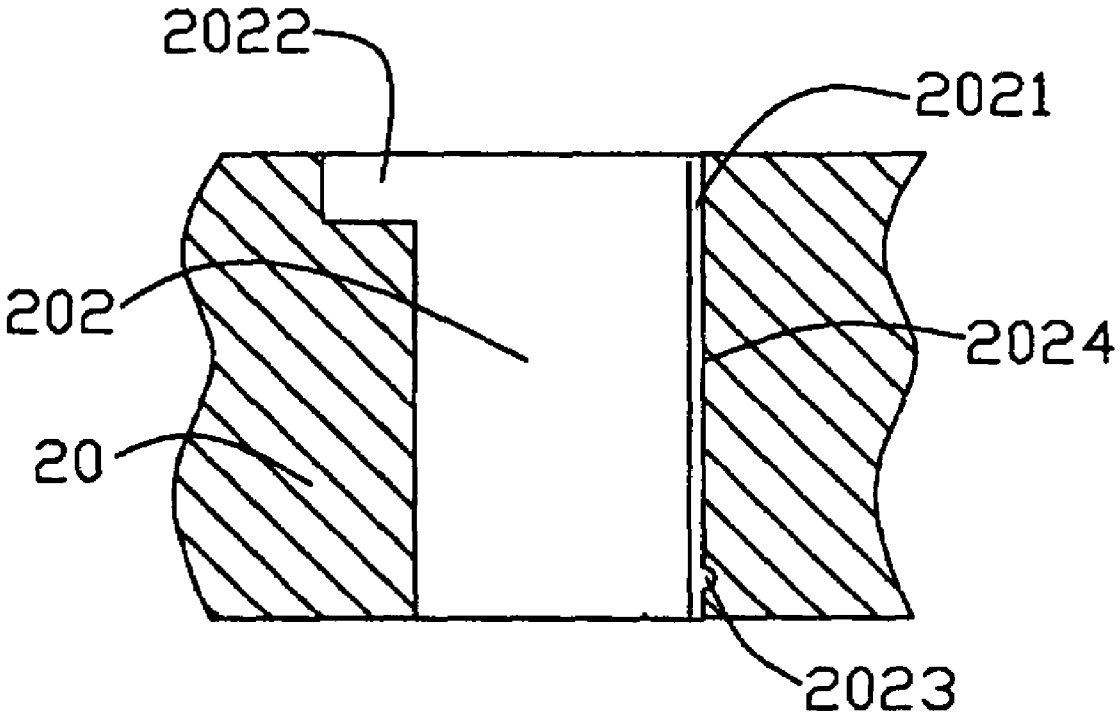
FIG. 5 depicts a partially cross-sectional view of the insulative housing taken in the direction of line IV—IV of FIG. 2.

As shown in FIG. 3 and FIG. 5, each of the passageways 202 defines a T-shaped cross-sectional configuration including a narrow fastening slot 2021 and a wide receiving slot 2022 communicating to each other. A lying sidewall 2024 at a longitudinal side of the narrow fastening slot 2021 correspondingly defines a recess 2023 therein, to receive the dome-shaped bulge 142. A pair of stepped lateral sidewalls (not numbered) is provided at two lateral sides of the narrow fastening slot 2021.

Figure 4:
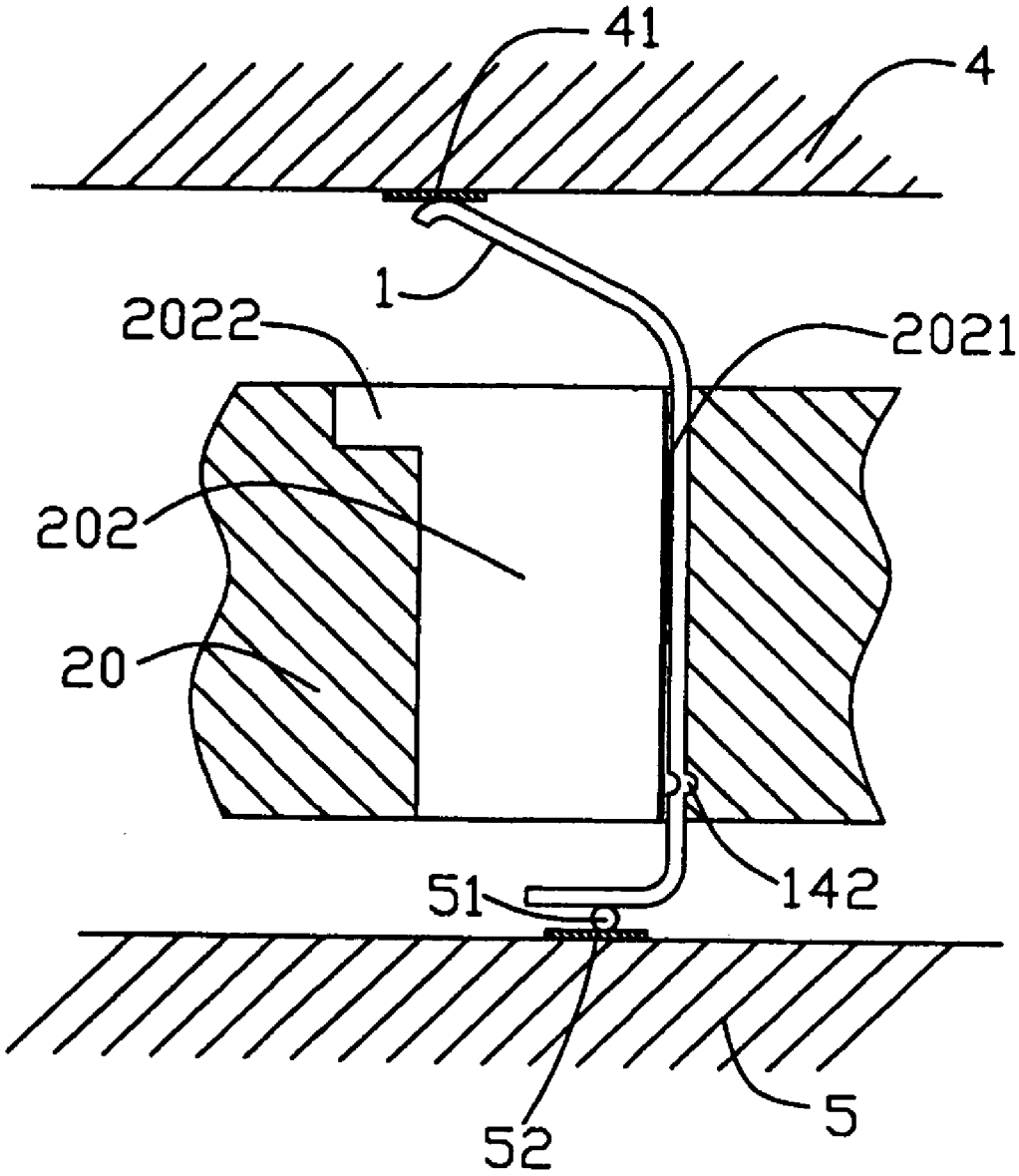
FIG. 4 depicts a partially cross-sectional view of the electrical connector taken in the direction of line IV—IV of FIG. 2, wherein the contact mates with a circuit pad on a PCB and a conductive pad on an IC package at two opposite ends thereof, respectively.

Assembly of the electrical connector 3 will now be described in greater detail. Turning now to FIGS. 3 and 4, the contact 1 is inserted into the passageway 202 downwardly. As the contact 1 slides down along the lying wall 2024, the upper fastening blocks 141 engages the opposite stepped lateral walls 2026. The dome-shaped bulge 142 resists the lying sidewall 2024 and moves down toward the recess 2023. When the contact 1 is in a fully inserted position, the fastening blocks 141 of the contact 1 interfere with the stepped lateral sidewalls in sequence. The dome-shaped bulge 142 is received in the corresponding recess 2023 defined in the lying sidewall 2024. Meanwhile, the upper spring arm 10 and the soldering pads 121 extend to the wide receiving slot 2022.

The mating of the dome-shaped bulge 142 with the recess 2023 not only enhances the inferential engagement between the planar medial section 14 and the lateral sidewalls, but also prevents the contact 1 from disengaging and deflecting from the passageway 202. As a result, the contact 1 can be stably and securely retained in the passageway 202.

Operation of the electrical connector 3 will now be described in greater detail. As illustrated in FIG. 4, in use, the soldering pads 121 of the contacts 1 are attached to the corresponding circuit pads on the PCB 5 via soldering balls 51. The upper spring arms 10 of the contacts 1 protrude beyond top surface of the insulative housing 20 with the arched apexes 101 situated in a same horizontal plane. When the IC package 4 is rest on the electrical connector 3, the conductive pads 41 thereof simultaneously register with the apexes 101 and resiliently press down the apexes 101. Thus, stable electrical connection between the IC package 4 and the PCB 5 is achieved.

While the present invention has been described with reference to a specific embodiment, the description of the invention is illustrative and is not to be construed as limiting the invention. Various of modifications to the present invention can be made to the preferred embodiment by those skilled in the art without departing from the true spirit and scope of the invention as defined by the appended claims.

What is claimed is:

1. An electrical connector comprising:

an insulative housing defining a plurality of passageways, each passageway defining a T-shaped cross-sectional configuration comprising a narrow fastening slot and a wide receiving slot in communication with each other, one sidewall facing the narrow fastening slot defining a recess thereon;

a plurality of contacts received in the corresponding passageways, respectively, each contact comprising a planar medial section interferingly received in the narrow fastening slot and an upper and a lower contacting sections extending from opposite ends thereof to the wide receiving slot, the medial section forming a bulge located substantially along a central line thereof and compliantly received in the recess for securely retaining the contact.

2. The electrical connector of claim 1, wherein the upper and the lower contacting sections are a pair of spring arms extending from opposite ends of the medial section, respectively.

3. The electrical connector of claim 1, wherein the upper contacting section is a spring arm extending upwardly from an upper end of the medial section, while the lower contacting section is a soldering pad extending downwardly from a lower end of the medial section.

4. The electrical connector of claim 3, wherein the bulge generally takes on a dome-shaped configuration.

5. The electrical connector of claim 3, wherein the bulge is positioned adjacent to the lower contacting section.

6. The electrical connector of claim 1, wherein there are two fastening blocks extending laterally in a coplanar manner with the medial section, and the two fastening blocks are laterally dimensioned different from each other in accord with different lateral structure of the narrow fastening slot.

7. An electrical connector comprising:

an insulative housing defining a plurality of passageways extending therethrough in a vertical direction;

a plurality of contacts disposed in the corresponding passageways, respectively, each of said contacts including a planar medial section with two opposite engagement portions extending from two opposite ends of said planar medial section a protrusion extending from said planar medial section and aligned with a center line of said medial section;

each of said passageways including a main receiving space essentially receiving said medial section and generally aligned with said two opposite engagement portions from said top view, and a recess located beside said main receiving space and compliantly receiving said protrusion.

8. The connector as claimed in claim 7, wherein said recess does not communicate with or is not open to an exterior directly in a vertical direction.

* * * * *